US007834900B2

(12) United States Patent
Ramesh et al.

(10) Patent No.: US 7,834,900 B2
(45) Date of Patent: Nov. 16, 2010

(54) METHOD AND APPARATUS FOR CORRECTING BANDING DEFECTS IN A PHOTORECEPTOR IMAGE FORMING APPARATUS

(75) Inventors: Palghat S. Ramesh, Pittsford, NY (US); Robert J. Kleckner, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/364,728

(22) Filed: Feb. 3, 2009

(65) Prior Publication Data

US 2010/0194842 A1 Aug. 5, 2010

(51) Int. Cl.
*B41J 2/47* (2006.01)

(52) U.S. Cl. ..... 347/240; 347/251

(58) Field of Classification Search ..... 347/234, 347/140, 248, 251–254
See application file for complete search history.

(56) References Cited

U.S. PATENT DOCUMENTS 6,111,593 A 8/2000 Henderson et al.
6,285,389 B1 9/2001 Genovese
6,285,463 B1 9/2001 Lin et al.
7,058,325 B2 6/2006 Hamby et al.
7,120,369 B2 10/2006 Hamby et al.
7,196,716 B2 * 3/2007 Rahnavard et al. ..... 347/239
7,283,143 B2 10/2007 Mizes et al.
7,400,339 B2 * 7/2008 Sampath et al. ..... 347/251
2008/0122460 A1 * 5/2008 Ichikawa et al. ..... 324/699
2008/0278566 A1 * 11/2008 Towner et al. ..... 347/243
2009/0002724 A1 1/2009 Paul et al.

* cited by examiner

*Primary Examiner*—Hai C Pham
(74) *Attorney, Agent, or Firm*—Oliff & Berridge, PLC

(57) ABSTRACT

A method and apparatus for correcting banding defects in a photoreceptor image forming apparatus. The method or apparatus may form one or more images using one or more laser beams to alter an electrostatic charge on a photoreceptor, check the one or more images for one or more sets of image perfections arising from electric field attenuation in the photoreceptor, and compensate for the electric field attenuation. The method or apparatus may further form a compensated image.

14 Claims, 16 Drawing Sheets

METHOD AND APPARATUS FOR CORRECTING BANDING DEFECTS IN A PHOTORECEPTOR IMAGE FORMING APPARATUS

BACKGROUND

Electrophotographic marking is a well known method of copying or printing documents by exposing a substantially uniformly charged photoreceptor to an optical light image of an original document, discharging the photoreceptor to create an electrostatic latent image of the original document on the photoreceptor's surface, selectively adhering toner to the latent image, and transferring the resulting toner pattern from the photoreceptor, either directly to a marking substrate such as a sheet of paper, or indirectly after an intermediate transfer step. The transferred toner powder image is fused to the marking substrate using heat and/or pressure to make the image permanent. Finally, the surface of the photoreceptor is cleaned of residual developing material and recharged in preparation for the creation of the next image.

While many types of light exposure systems have been developed, a commonly used system is the raster output scanner (ROS) comprised of a laser beam, or beams, a means for modulating the laser beam (which, as in the case of a laser diode, may be the action of turning the source itself on and off) so that the laser beam contains image information, a rotating polygon mirror having one or more reflective surfaces, pre-polygon optics for collimating the laser beam, post-polygon optics to focus the laser beam into a well-defined spot on the photoreceptor surface and to compensate for the mechanical error known as polygon wobble, and one or more path folding mirrors to reduce the overall physical size of the scanner housing. The laser source, modulator, and pre-polygon optics produce a collimated laser beam which is directed to strike the reflective polygon facets. Some of these systems utilize a vertical cavity surface emitting laser (VCSEL) as the laser beam source.

As the polygon rotates, the reflected beam passes through the post-polygon optics and is redirected by any folding mirrors to produce a focused spot that sweeps along the surface of the charged photoreceptor in a straight scan line. Since the photoreceptor moves in a direction substantially perpendicular to the scan line, the swept spot covers the entire photoreceptor surface in a raster pattern. By suitably modulating the laser beam in accordance with the position of the exposing spot at any instant, a desired latent image can be produced on the photoreceptor.

However, imagers of this type frequently experience banding defects during the imaging process. Banding defects are defects in the latent image, in which multiple scan lines do not print evenly. This results in a visible banding effect, in which some scan lines in the final image appear lighter than other lines of theoretically equal tone.

Some of the most common sources of banding defects are due to the imager. Examples are ROS once-per-polygon revolution wobble, jitter, and beam to beam differences. Much of the work has focused on the various mechanical causes of banding and how interlacing schemes can decrease sensitivity to these banding sources. Some of the known mechanical sources of banding include magnification errors, array rotation, and beam non-uniformity.

However, all of the sources of blanding defects are not fully understood, and some banding defects seem to arise that defy predictive efforts and known mechanical solutions.

SUMMARY

Applicants have investigated these unexplained banding defects, and as a result of this work, discovered that these defects can also occur due to quantum level effects within the photoreceptor. Specifically, it was discovered that neighboring swaths of pixels were attenuating the electrical field being created by the laser beams as they discharged along certain scan lines, as fully discussed below. This attenuation of the electric fields in the photoreceptor was found to be a source of the banding defects, as the attenuation disrupted the charge intended for a current scan line, resulting in undesirable banding.

Based on this work, a method for correcting banding defects in a photoreceptor image forming apparatus, a method for generating a power distribution profile to modulate one or more laser beams so as to compensate for field attenuation in a photoreceptor image forming apparatus, and an image forming apparatus utilizing these methods were developed to counteract the problem.

In various exemplary embodiments, the systems and methods according to this disclosure may provide a method for correcting banding defects in a photoreceptor image forming apparatus. The method may comprise a step of forming one or more images using one or more laser beams to alter an electrostatic charge on a photoreceptor. The method may further check the one or more images for one or more sets of image perfections arising from electric field attenuation in the photoreceptor. The method may further compensate for the electric field attenuation. Finally, the method may form a compensated desired image.

In various exemplary embodiments, the compensating step may further comprise of the steps for generating a power distribution profile for the one or more laser beams and modulating the one or more laser beams based on the power distribution profile. In various exemplary embodiments, the modulation involves altering at least one of a driving voltage, an intensity or a duration of the one or more laser beams. In further various exemplary embodiments, the power distribution profile is generated based on the set of image imperfections.

In various exemplary embodiments, the systems and methods according to this disclosure may provide that the set of image imperfections is a set of luminance value errors $\Delta L_i^*$, and that a laser beam j of the one or more laser beams is modulated to alter an exposure of the laser beam by $\Delta p_j$. In this exemplary embodiment $\Delta p_j$ is found by minimizing the formula $$\sum_i (\Delta X_i - \Delta X_i^*)^2;$$

$$\text{where } \Delta X_i = \frac{\Delta L_i^*}{S_L(X)} \text{ and } \Delta X_i^* = \sum_{j=1}^{N_b} \beta_{ij} \Delta p_j;$$

and where:

$S_L(X)$ is a slope of a luminance as a function of exposure curve at exposure X, $\beta_{ij}$ is an exposure contribution for laser beam j at location i, and $N_b$ is the total number of laser beams.

In further various exemplary embodiments, the checking step involves the step of comparing the one or more formed images against one or more corresponding predetermined expected images. In further various exemplary embodiments, the one or more images each have a different halftone level and the compensating step compensates based on the halftone level of a desired image to be formed.

In further various exemplary embodiments, the method further involves generating two or more power distribution profiles based on two or more sets of image imperfections. The method also determines a desired halftone level of the desired image to be formed. The method then interpolates or extrapolates a desired power distribution profile from the two or more power distribution profiles based on the desired halftone level as compared to the halftone levels of the images the two or more power distribution profiles were generated from. Finally, the method compensates for electric field attenuation using the desired power distribution profile.

In various exemplary embodiments, this method may be employed by a xerographic machine.

In various exemplary embodiments, the systems and methods according to this disclosure may also provide a method for generating a power distribution profile to modulate one or more laser beams so as to compensate for electric field attenuation in a photoreceptor image forming apparatus. The method may comprise a step of forming an image using the one or more laser beams to alter the electrostatic charge on a photoreceptor. Next the method checks the image for a set of image imperfections arising from electrostatic charge attenuation. Finally, the method generates a power distribution profile for the one or more laser beams based on the set of image imperfections.

In further various exemplary embodiments, the set of image imperfections are obtained by comparing the formed image against a predetermined expected image. In further various exemplary embodiments, the power distribution profile is such that an exposure generated by any given laser beam j of the one or more laser beams is altered by an exposure modulation $\Delta p_j$. In this exemplary embodiment the set of image imperfections is a set of luminance value errors $\Delta L_i^*$, and $\Delta p_j$ is found by minimizing the formula $$\sum_i (\Delta X_i - \Delta X_i^*)^2;$$

$$\text{where } \Delta X_i = \frac{\Delta L_i^*}{S_L(X)} \text{ and } \Delta X_i^* = \sum_{j=1}^{N_b} \beta_{ij} \Delta p_j;$$

and where:

$S_L(X)$ is a slope of a luminance as a function of exposure curve at exposure X, $\beta_{ij}$ is an exposure contribution for laser beam j at location i, and $N_b$ is the total number of laser beams.

In various exemplary embodiments, the systems and methods according to this disclosure may also provide for an image forming apparatus. This apparatus may have a photoreceptor having an electrostatic charge. The apparatus may further have one or more laser light sources capable of altering the electrostatic charge. The apparatus may also have an image forming material that is attracted to the electrostatic charge of the photoreceptor in proportion to the electrostatic charge. The apparatus may further have a laser control unit for individually controlling a driving voltage, intensity and duration of a plurality of laser beams generated by the one or more laser light sources. The apparatus may also have a modulation unit for modulating one or more of the laser beams to compensate for field attenuation.

In further various exemplary embodiments, the modulation unit modulates the one or more laser beams based on a power distribution profile. In further various exemplary embodiments, the apparatus further has a testing unit for comparing an electrostatic profile on the photoreceptor against an expected electrostatic profile for a particular image to generate an imperfection profile and a power distribution profile generating unit that generates a power distribution profile based on the imperfection profile. In this exemplary embodiment the modulation unit modulates the one or more laser beams based on the power distribution profile. In various exemplary embodiments, the modulation involves altering at least one of a driving voltage, an intensity or a duration of the one or more laser beams.

In various exemplary embodiments a laser beam j of the one or more laser beams is modulated to alter an exposure of the laser beam by $\Delta p_j$. In this exemplary embodiment $\Delta p_j$ is found by minimizing the formula $$\sum_i (\Delta X_i - \Delta X_i^*)^2;$$

$$\text{where } \Delta X_i = \frac{\Delta V_i}{S_v(X)} \text{ and } \Delta X_i^* = \sum_{j=1}^{N_b} \beta_{ij} \Delta p_j;$$

and where:

V is a voltage profile of an exposure image, $\Delta V_i$ is a change in voltage profile at location i, $S_v(X)$ is a slope of a photo induced discharge curve at exposure X, $\beta_{ij}$ is an exposure contribution for laser beam j at location i, and $N_b$ is the total number of laser beams.

In further various exemplary embodiments, FWA profile of a uniform half tone area is used as a surrogate for the voltage profile (V). In further various exemplary embodiments, the apparatus further has a voltage profile determining unit that determines the voltage profile (V) of a latent image by determining $\Delta V_i$ at a plurality of locations, where i is a matrix designation for each of the plurality of locations. The apparatus further has a testing unit for comparing against an expected electrostatic profile for a particular image to be formed against the voltage profile of the latent image and a power distribution profile generating unit that generates a power distribution profile based on the imperfection profile. In this exemplary embodiment the modulation unit modulates the one or more laser beams based on the power distribution profile.

DETAILED DESCRIPTION OF EMBODIMENTS

Figure 1:
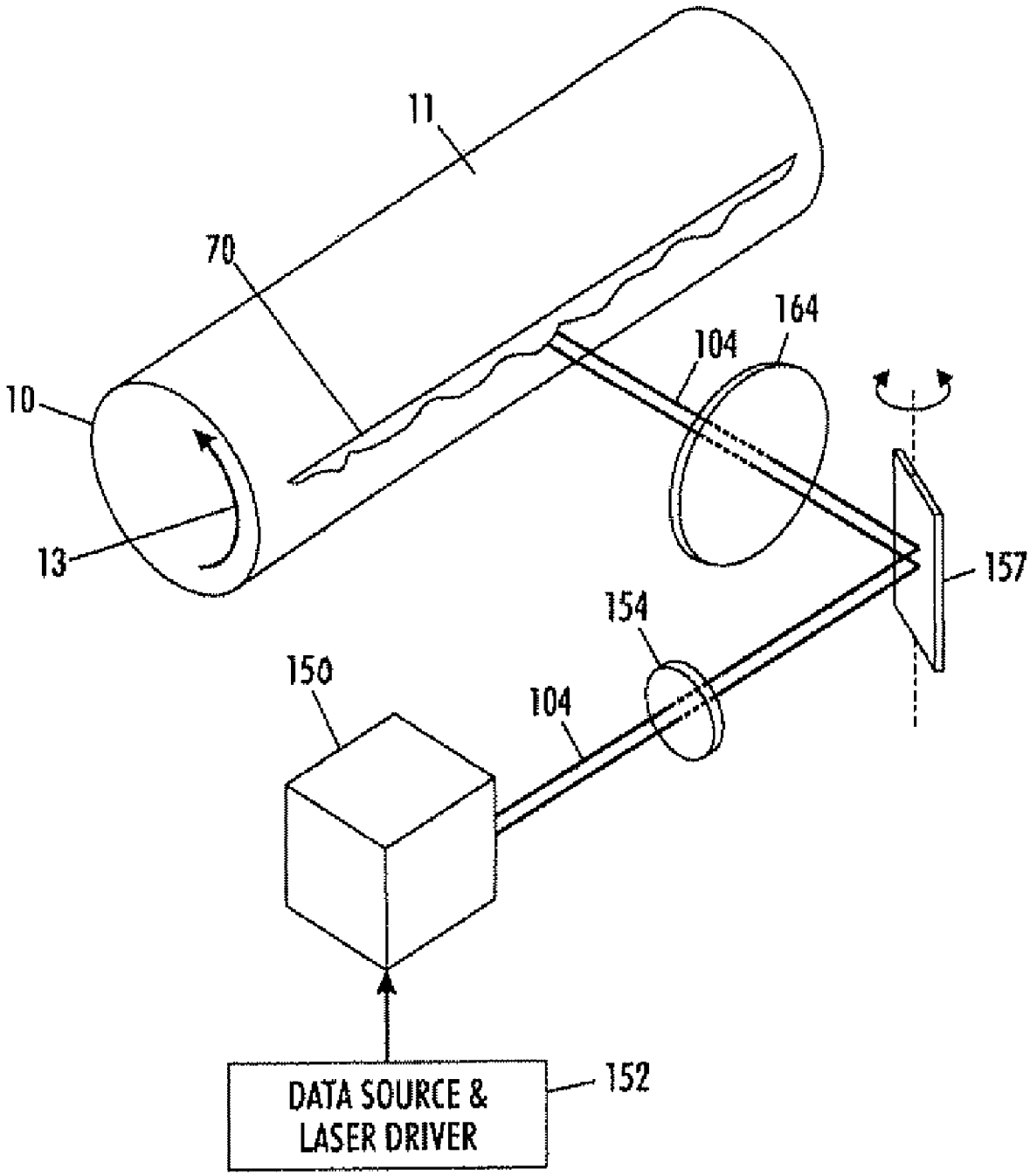
FIG. 1 is an exemplary model of portions of the apparatus of this application in a plan view.
Figure 2:
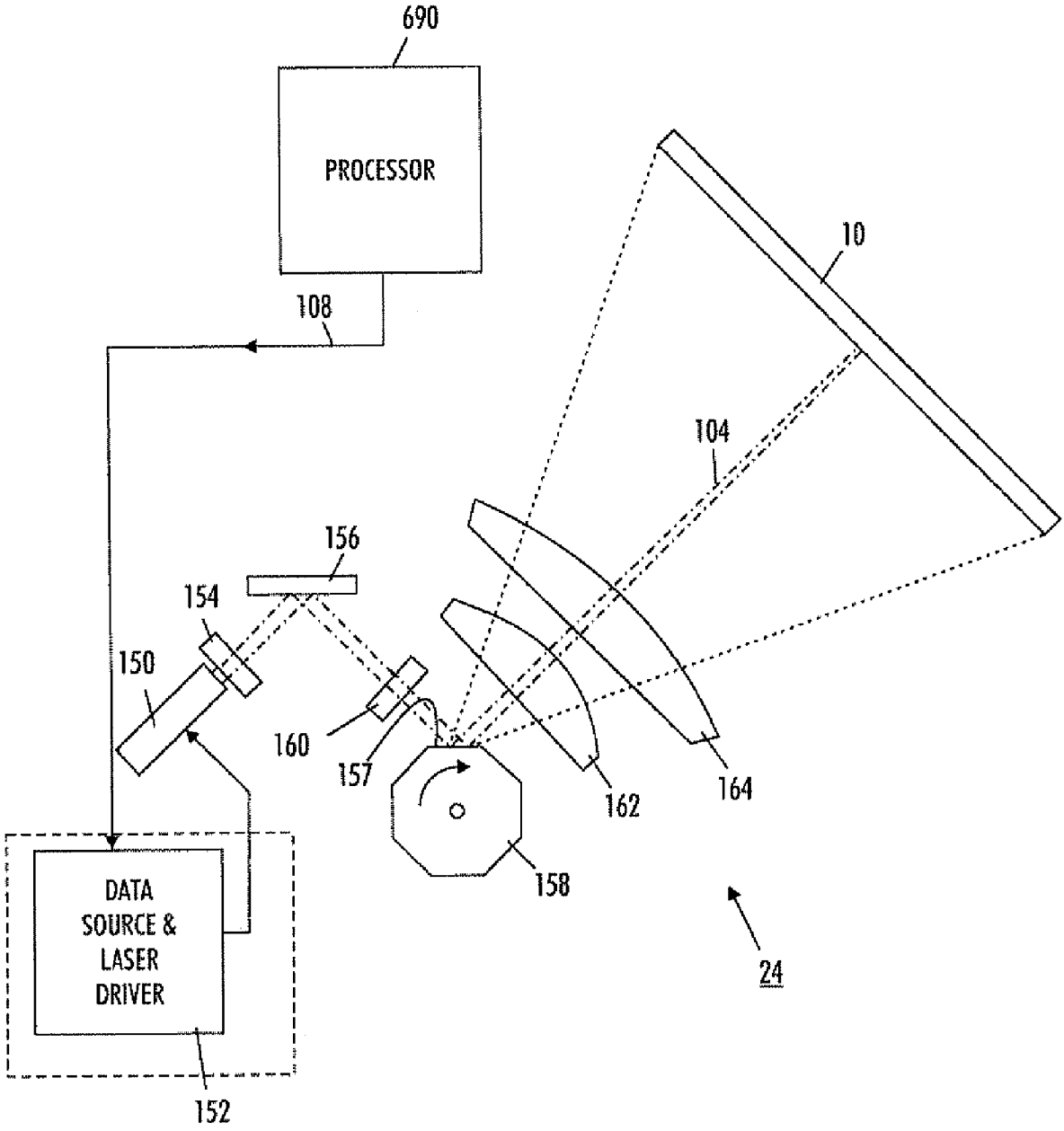
FIG. 2 is an exemplary model of portions of the apparatus of the application in an overhead view.

FIGS. 1 and 2 illustrates an exemplary copier/printer machine employing scanned light beam imaging on an photoreceptive surface 11 of a photoreceptor 10. This photoreceptor may be a drum shape, a planar surface, or any other shape as know in the image forming art. The surface 11 of the photoreceptor 10 may be a coated surface or in the form of a sheet material formed on the photoreceptor, as known in the art.

As shown in FIGS. 1 and 2, a laser 150 generates a coherent light beam 104 (alternatively referred to as a laser beam). The light beam 104 may then be projected through one or more pre-polygon optics 154, 160 to a beam deflector 158. For space saving purposes the light beam 104 may also be reflected off one or more fold mirrors 156. For example, in FIG. 2 the light beam 104 from laser 150 is collimated by optical element 154, reflected by fold mirror 156 and then focused on the beam deflector 158 by optical element 160.

The beam deflector 158 may comprise an oscillating mirror or a rotating mirror assembly having many facets about the periphery thereof. In the example shown, the beam deflector 158 takes the form of a rotating polygon having a plurality of reflective facets 157. The light beam 104 is deflected by the reflective facet 157 and is projected through one or more imaging lens 162, 164 onto the photoreceptive surface 11 of the photoreceptor 10. The beam deflector 158 causes the light beam 104 to be scanned axially on the photoreceptor 10 forming a scan line 70 across the photoreceptive surface 11. When using a rotating polygon beam deflector 158, each facet 157 of the rotating polygon deflects the light beam 104 which is focused into a well defined spot on the surface of photoreceptor 10 by scan lens elements 162 and 164.

The beam spot diameter, which is greatly exaggerated in the figures for illustrative purposes, defines the width of the scan line 70. The width of the scan line 70 may be the subject of slight variations. These variations may be from machine to machine, as variations in the provided laser or in the optics, or in distance tolerances, as in the distance from the post-polygon lenses 162, 164 to the surface 11 of the photoreceptor 10. As beam deflector 158 rotates, the sharply focused spot formed by laser beam 104 traces a narrow path on the surface of photoreceptor 10 that defines the scan line 70.

As mentioned earlier, the surface 11 of the photoreceptor 10 comprises a photoreceptor. This photoreceptor is typically an electrostatic material. At the beginning of the image forming process, the electrostatic material on the surface of the photoreceptor 10 is uniformly charged at some preset level. When the light beam 104 is incident on the electrostatic material, photons in the light beam alter the charge. Each light beam 104 typically is incident at a single spot at a single time, and alters the electrostatic charge of the photoreceptor at a single point. This point is called a pixel 212. As the image forming process progresses, a plurality of pixels are formed on the photoreceptor and together form a "latent image" 670 on the photoreceptor surface.

Figure 17:
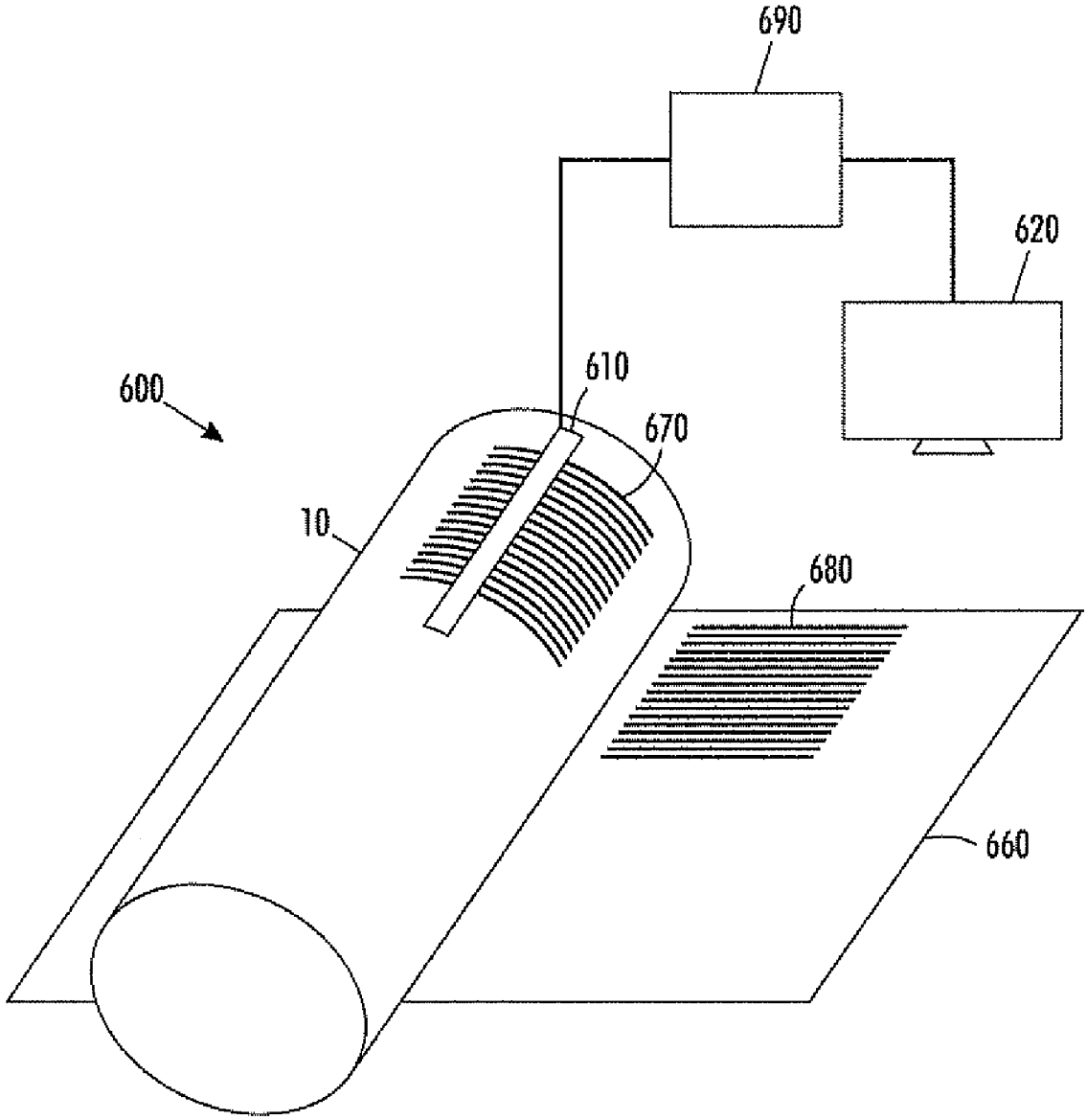
FIG. 17 is an exemplary model of portions of the apparatus in plan view.

Subsequently, in a writing stage, a printing material, such as toner, will typically be placed in proximity to the electrostatic surface 11. This process can be seen in FIG. 17, is shown in an exemplary writing section 600 of an image forming apparatus. The printing material 670 is attracted to the electrostatic charge of the latent image on the photoreceptor, in proportion to the amount of electrostatic charge at any point. Once the printing material has adhered to the photoreceptor, the printing material is transferred to a writing substrate 660, such as paper. It is then fused to the paper by either heat or pressure, thereby forming the "printed image" 680.

For high speed marking applications, multiple laser beam imagers, such as the VCSEL ROS, are frequently used. In some multi-beam imagers a VCSEL ROS is required. For these imagers, images are written on the photoreceptor in swaths 202. These swaths consist of series of pixels 212, 214. Each pixel in each swath is formed by a given laser beam from among the multiple laser beams, and each swath has N pixels, where N is a total number of laser beams.

Figure 3A:
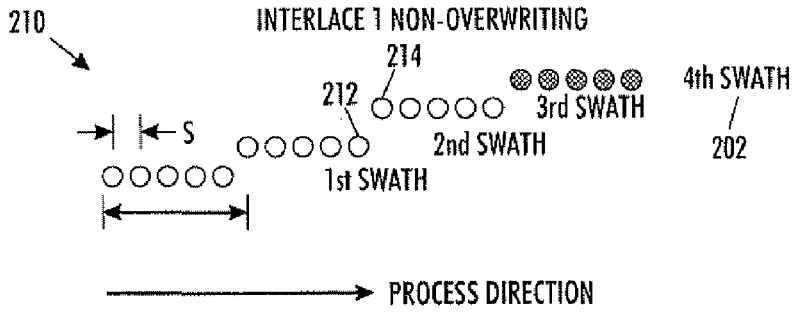
FIGS. 3*a-c* are demonstrative interlace patterns for pixel formation.
Figure 3B:
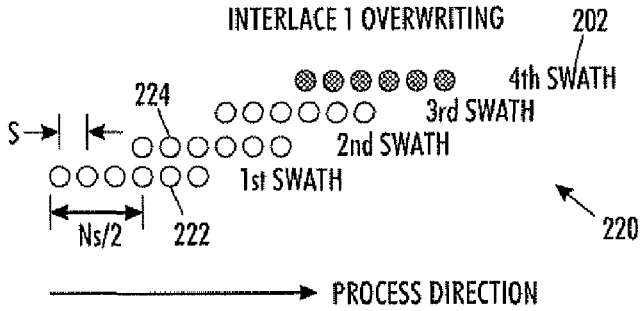
Figure 3C:
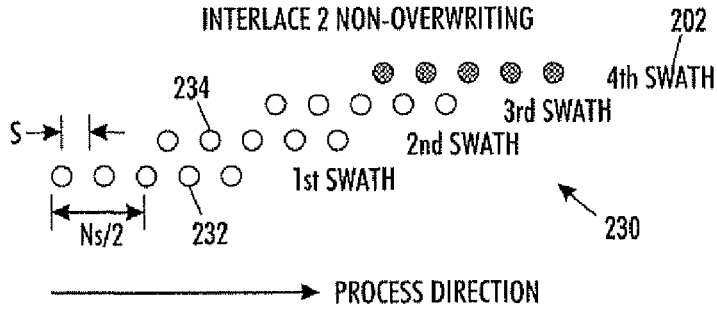

The swaths 202 are laid down in interlace schemes 210, 220, 230. FIGS. 3*a-c* show several different examples of such interlace schemes. Interlace schemes can be dividing into overwrite and non-overwrite schemes. In overwrite schemes the swaths 202 overlap and the pixels 222, 224 in those swaths are overwritten. This concept is illustrated in FIG. 3*b*. FIG. 3*a* shows a non-overwrite interlace scheme 210, in which the swaths 202 do not overlap. FIG. 3*c* shows a non-overwrite scheme in which the swaths 202 overlap, however, the pixels are not overwritten, as demonstrated by the staggered position of pixel 232 and pixel 234.

Each swath 202 exposes an area on the photoreceptor of length N*s, where s is the spacing between the laser beams. In addition, each laser beam in the swath has a profile which is dependent on the optics of the imaging system. The full width at half maximum of this profile is frequently referred to as the laser spot size. The laser beams in a single swath expose the photoreceptor simultaneously, while the exposure by different swaths are staggered in space and time in a manner defined by the interlace scheme. As will be discussed later, the beam spot size, the beam to beam spacing and the interlace scheme affects the electric field attenuation.

In many printers known in the art, banding defects would sometimes arise in the latent image. Banding defects are defined as defects in which some or all of a given scan line is printed with an improper luminance level (L*), and this pattern repeats periodically in the process direction. In printed images having banding defects neighboring scan lines appear lighter and darker than each other, thus giving rise to a banding effect.

Several mechanical defects within printers similar to those shown in FIGS. 1 and 2, are known to cause banding defects arising in the latent image. Among them are defects attributed to the polygon deflector 158, such as polygon mirror wobble. Thus, when banding defects arose in printers matching the frequency of polygon mirror wobble, those of skill in the art typically attempted to solve the banding defect problem by replacing the polygon deflector 158.

However, this solution may not solve the banding defects. Furthermore, these persistent banding defects can often appear inconsistently, in a manner that defied prediction or explanation. Prior to investigation undertaken by the Applicants ("the investigation"), as described below, no explanation as to the source of the problem or solution had been found for correcting these types of banding defects.

The investigation sought to explain the banding defects by examining the electrostatic printing process on a theoretical level, and examining the energy interactions on the electrostatic surface of the photoreceptor at the quantum level.

Figure 4A:
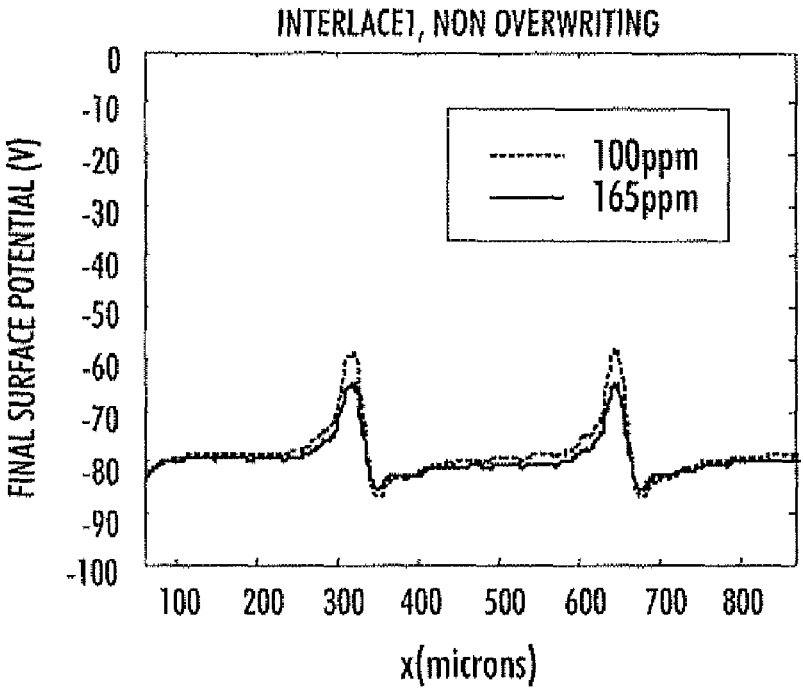
FIGS. 4*a-c* are graphs showing a simulated voltage profile of a latent image formed using the interlace patterns of FIGS. 3*a-c*.
Figure 4B:
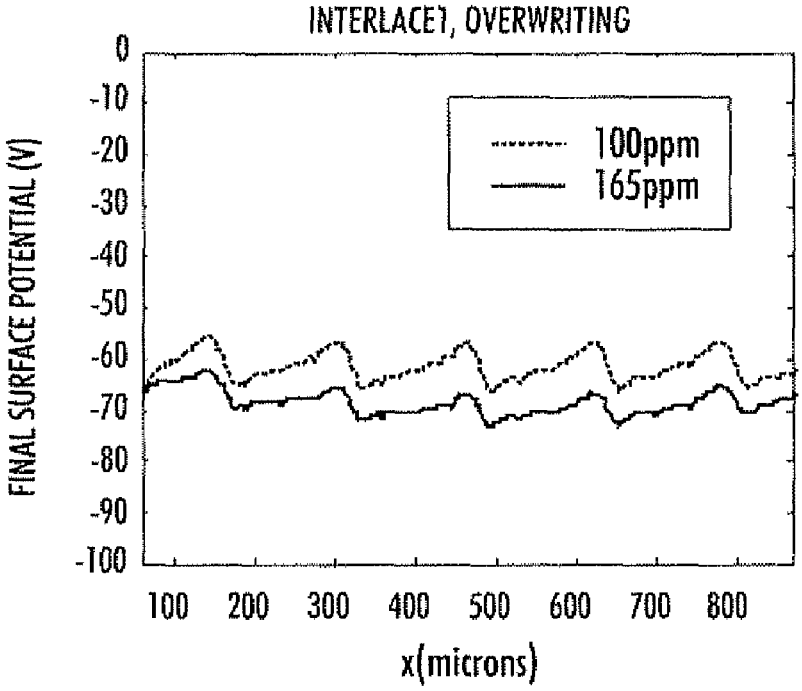
Figure 4C:
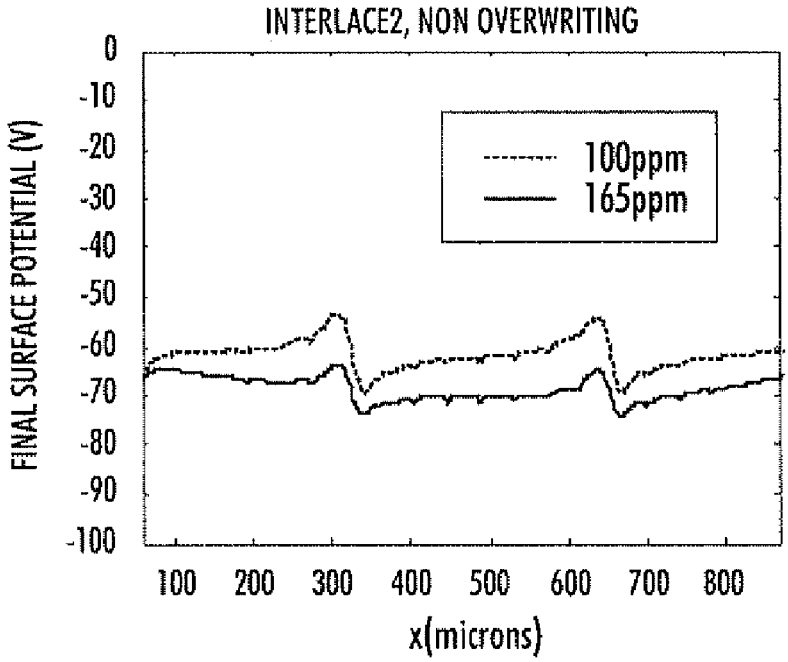

A photoreceptor charge transport model was used to simulate the effect of interlacing on a latent image. FIG. 4*a-c* shows a simulated latent image voltage profile (V) on the photoreceptor surface for a solid area exposure for the three interlace schemes shown in FIG. 3. The X-axis measures the distance along the process direction in microns. The Y-axis measures the surface voltage of the electrostatic surface.

As seen in FIGS. 4*a-c*, the voltage profile (V) along the scan line showed substantial non-uniformities. For example, in FIG. 4*a*, spikes in surface potential occurred at ~300 microns and at 650 microns. It was determined that these voltage non-uniformities were large enough to produce a visual banding artifact.

Table 1 summarizes the voltage non-uniformities as well as their frequencies for the various interlacing schemes at two different process speeds.

TABLE 1

Summary of voltage non-uniformity in latent image and freq. versus interlace scheme and speed

| Architecture | ΔV | Freq. (cyc./mm) |
|---|---|---|
| Interlace 2 non overwriting, 110 ppm | 15.8 V | 3.05 |
| Interlace 1, non overwriting, 110 ppm | 28.4 V | 3.05 |
| Interlace 1, overwriting, 110 ppm | 10.6 V | 6.3 |
| Interlace 2 non overwriting, 165 ppm | 10.6 V | 3.05 |
| Interlace 1, non overwriting, 165 ppm | 20.0 V | 3.05 |
| Interlace 1, overwriting, 165 ppm | 10.8 V | 6.3 |

After further study, the origin of these voltage irregularities was determined. Consider FIG. 4*c*, which corresponds to interlace 2 non-overwriting pattern of FIG. 3*c*. In this example, the exposure energy was at 2 ergs/cm$^2$. In this case, three swaths interact to produce the high and the low spot in the voltage profile. These swaths will be referred to as the i swath, the i+1 swath and the i−1 swath.

Figure 5:
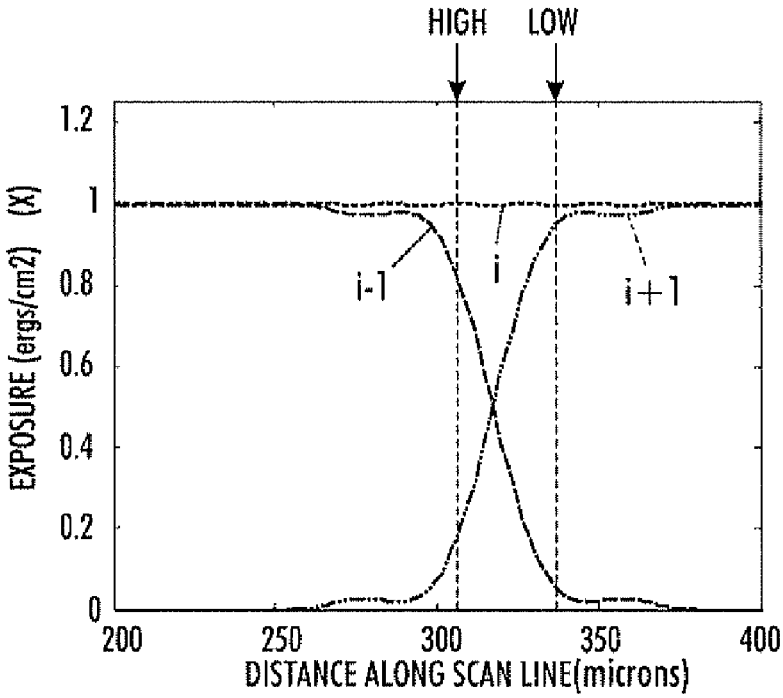
FIG. 5 is a graph of exposure versus distance for multiple pixel swaths.
Figure 6:
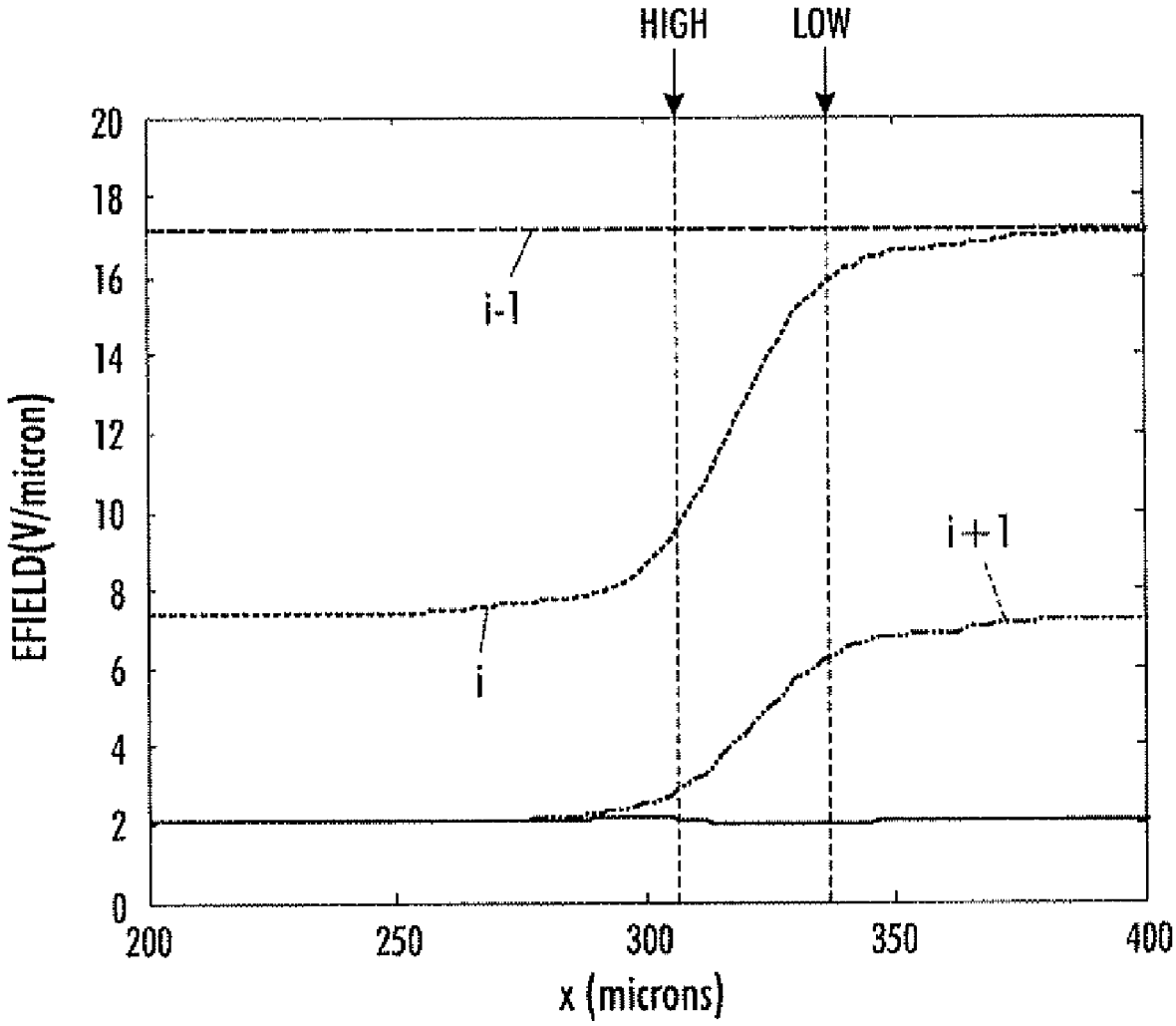
FIG. 6 is a graph of electric field versus distance for multiple pixel swaths.

FIG. 5 shows the exposure profile of these swaths near the high and low spots. It can be seen that the high spot on the voltage profile occurs near the end of the i−1$^{th}$ swath while the low spot occurs near the beginning of the i+1$^{th}$ swath. FIG. 6 shows the electric field at the generator layer during the i−1, i and i+1 swaths. For swath i−1, the electric field is constant, but for swaths i and i+1 the electric fields were found to be substantially altered.

It was determined that for swaths i and i+1 the electric fields were being attenuated by charges in transit from previous swaths. To fully understand this concept, consider the effect a laser beam has on a photoreceptor. The laser beam is composed of a plurality of photons that impact the surface of the photoreceptor. The photons excite the material in the charge generator layer of the photoreceptor, generating electron-hole pairs. The positively charged holes are transported through a transport layer by the electric field and create the exposure image on the surface. Therefore, to grossly simplify the process, the photons are converted into charge to create an electrostatic latent image on the surface of the photoreceptor.

Furthermore, in a typical photoreceptor the amount of charge V generated at a point is directly related to the number of photons that are converted. This relationship is defined as $V(V_i,X)$ and is called the photo induced discharge curve (PIDC). A photoreceptor with initial surface voltage $V_i$, when exposed with exposure X, will discharge to a final voltage V. The amount of charge generated per unit area during exposure is given by $(V-V_i)$ . . . $S_v(X)$ is the slope of a photo induced discharge curve ("PIDC") at exposure X. Thus, $$S_v(X)=dV/dX \tag{1}$$

In other words, S(X) defines the attenuation of charge V that will be generated for a given attenuation in exposure about exposure X.

Furthermore, for a given photoreceptor and image forming apparatus, a given amount of charge generated will yield a given luminance value L* in the printed image. Thus, it is further possible to know the relationship of how much luminance L* will be obtained from a given amount of exposure X. This relationship is defined as $S_L(X)$. In which, $$S_L(X)=dL^*/dX \tag{2}$$

Note that V is sometimes referred to as voltage or the voltage profile. Charge, or voltage V is different from the driving voltage of a laser beam. Charge refers to the number of volts worth of charge in the photoreceptor at the given point.

To summarize, for every given amount of extra exposure ΔX a change in charge ΔV will occur on the photoreceptor. Additionally, for every change in charge ΔV, the final formed image will have a change in luminance ΔL*. The luminance L*, is of course, the L* in the L*a*b* values, that are well known by those in the image forming art. Furthermore, as explained above, the amount of change in charge ΔV for a given amount of exposure ΔX is determined by the collection efficiency of the photoreceptor.

Figure 7:
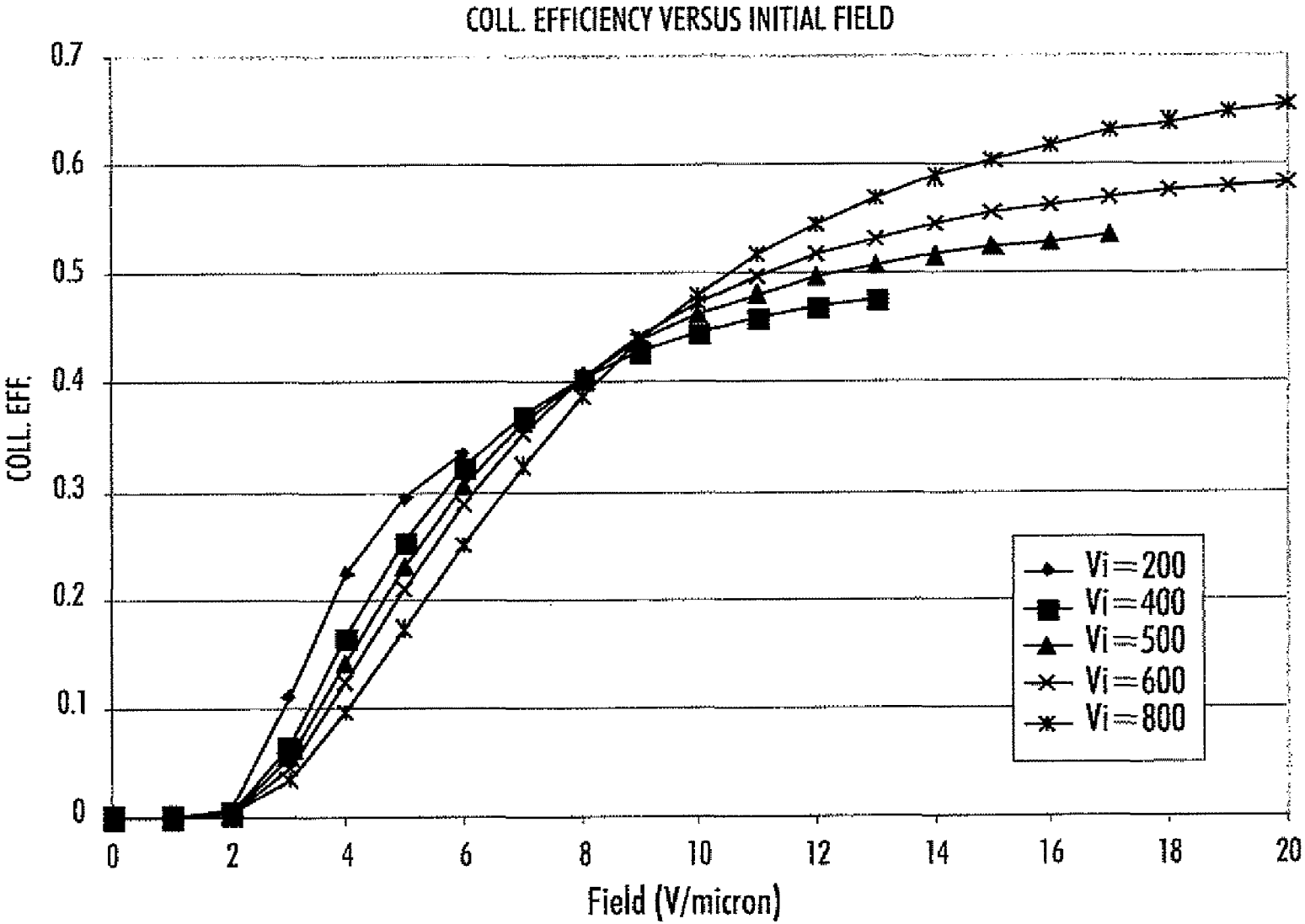
FIG. 7 is a graph of collection efficiency versus electric field strength.

However, collection efficiency, which is the efficiency with which photons are converted into electron-hole pairs, depends on the electric field at the generator layer. FIG. 7 charts the collection efficiency of a photoreceptor surface by exposed laser beams having driving voltages ranging from 200-800 volts. The collection efficiency was obtained by fitting the Quadratic Melnyk function to experimental PIDC data. The X-axis represents the electric field at a given point on the generator layer, while the Y-axis charts collection efficiency. As can easily been seen, as the electric field rises from 2-10 V/micron the collection efficiency of the photoreceptor dramatically improves from almost 0 to 0.4.

Therefore, if the electric field at on the photoreceptor surface 11 is different at two points, and an identical light beam impacts these two points, two pixels having different amounts of charge will be created. However, luminance levels (L*) in printing are calculated based on the principle that a constant laser beam will produce a constant charge on the photoreceptor 10. Thus, alterations to the electric field on the surface of the photoreceptor 10, will results in errors in the luminance of pixels in the latent image 670.

Figure 8:
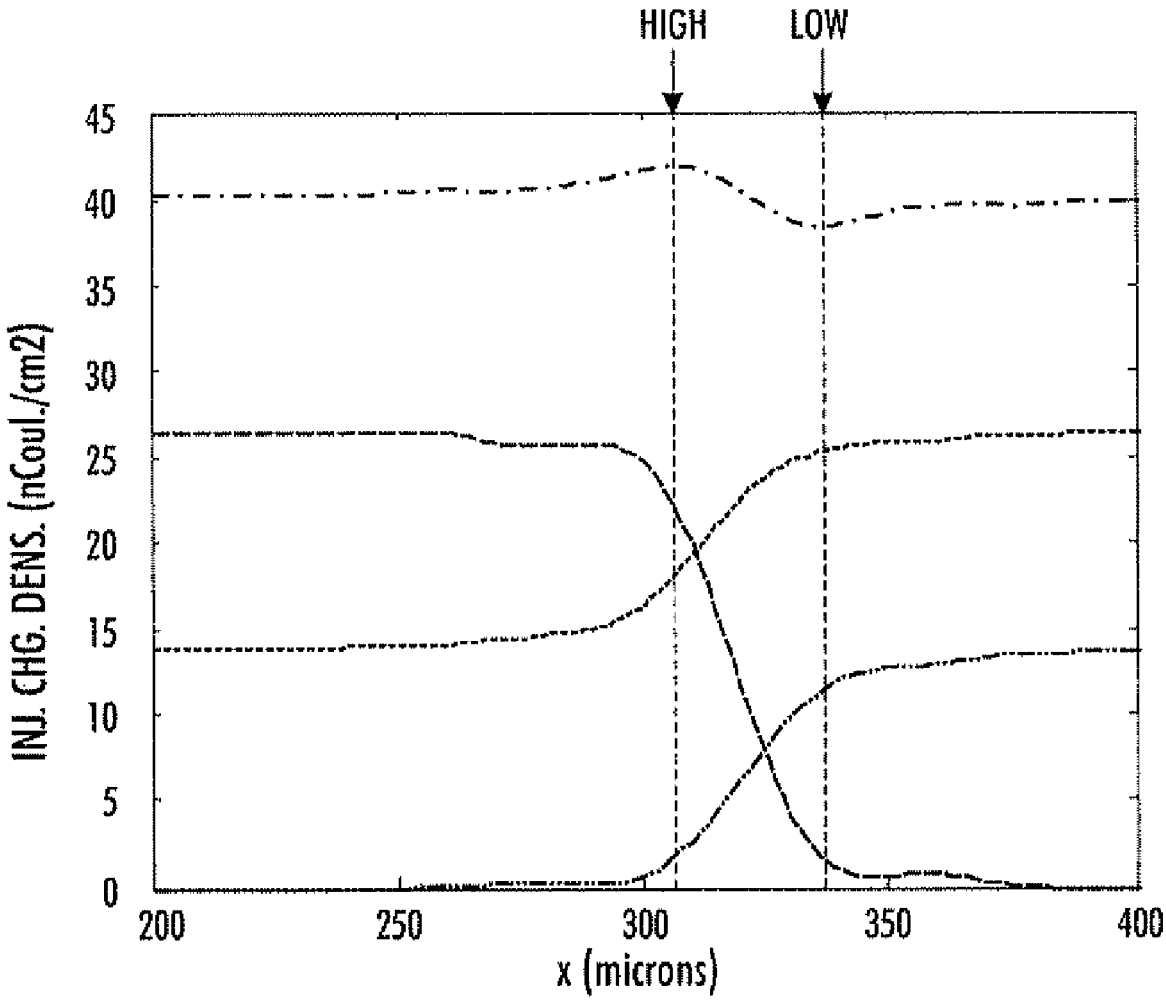
FIG. 8 is a graph of injected charge density versus distance.

Based on the analyses, it was determined that the electric fields at locations on the photoreceptor 10 were being affected in a repeating pattern. Specifically, it can be seen that the regions where the i−1 and i+1 swaths overlap, experienced inhomogeneous electric fields. Ideally, a laser beam 104 would experience approximately 15-20 V/micron of electric field at the generator layer point they strike. However, as shown in FIG. 6, it was determined that some beams in the i and i+1 swaths experienced significantly lower electric fields at the time of exposure. This resulted in the disparities in charge observed. FIG. 8 shows the charge (holes) generated at the generator layer for swaths i−1, i and i+1. Also shown is the total charge generated from all the swaths as a function of location in the process direction. The high and low spots in the voltage profile can be traced to the high and low levels of total charge generated at the generator layer at these locations.

Figure 9:
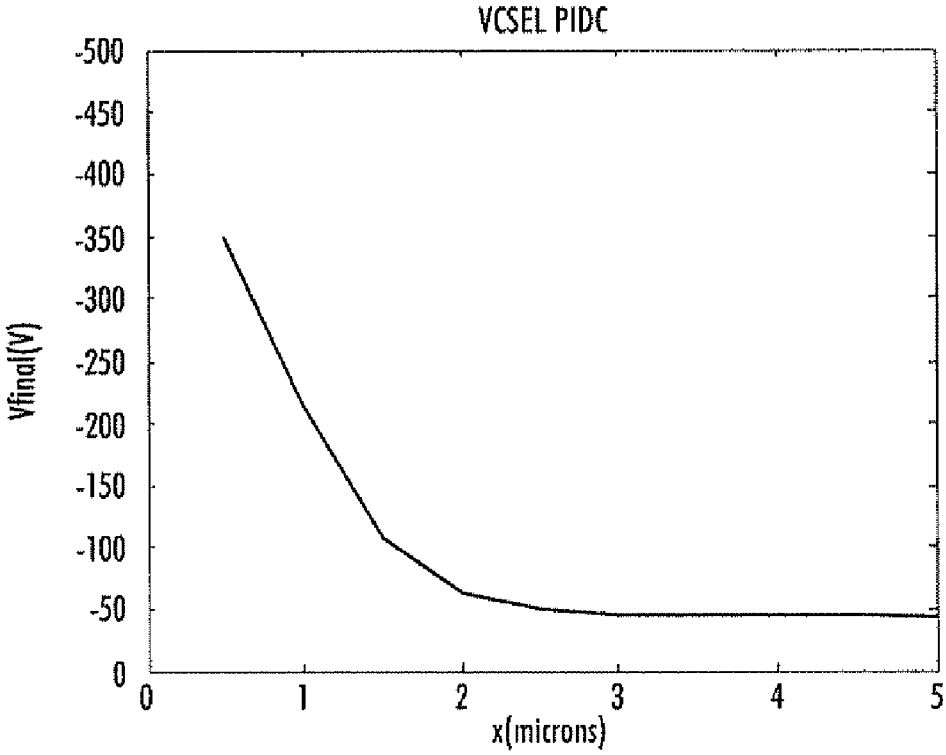
FIG. 9 is a graph of a typical voltage profile for given exposures.
Figure 10:
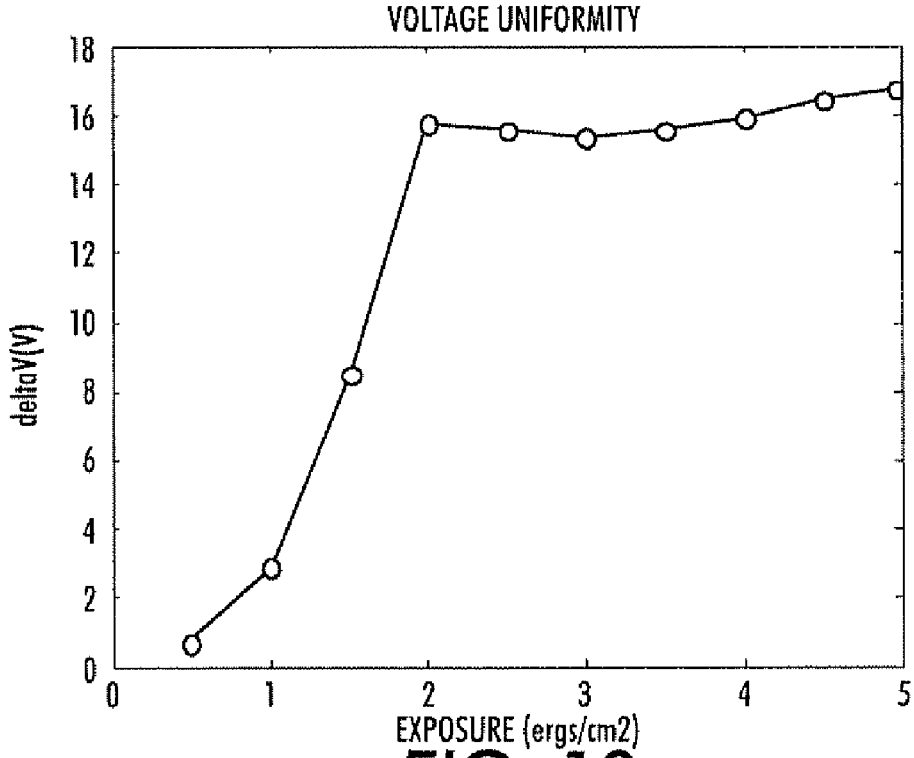
FIG. 10 is a graph of typical changes in voltage for given exposures.
Figure 11:
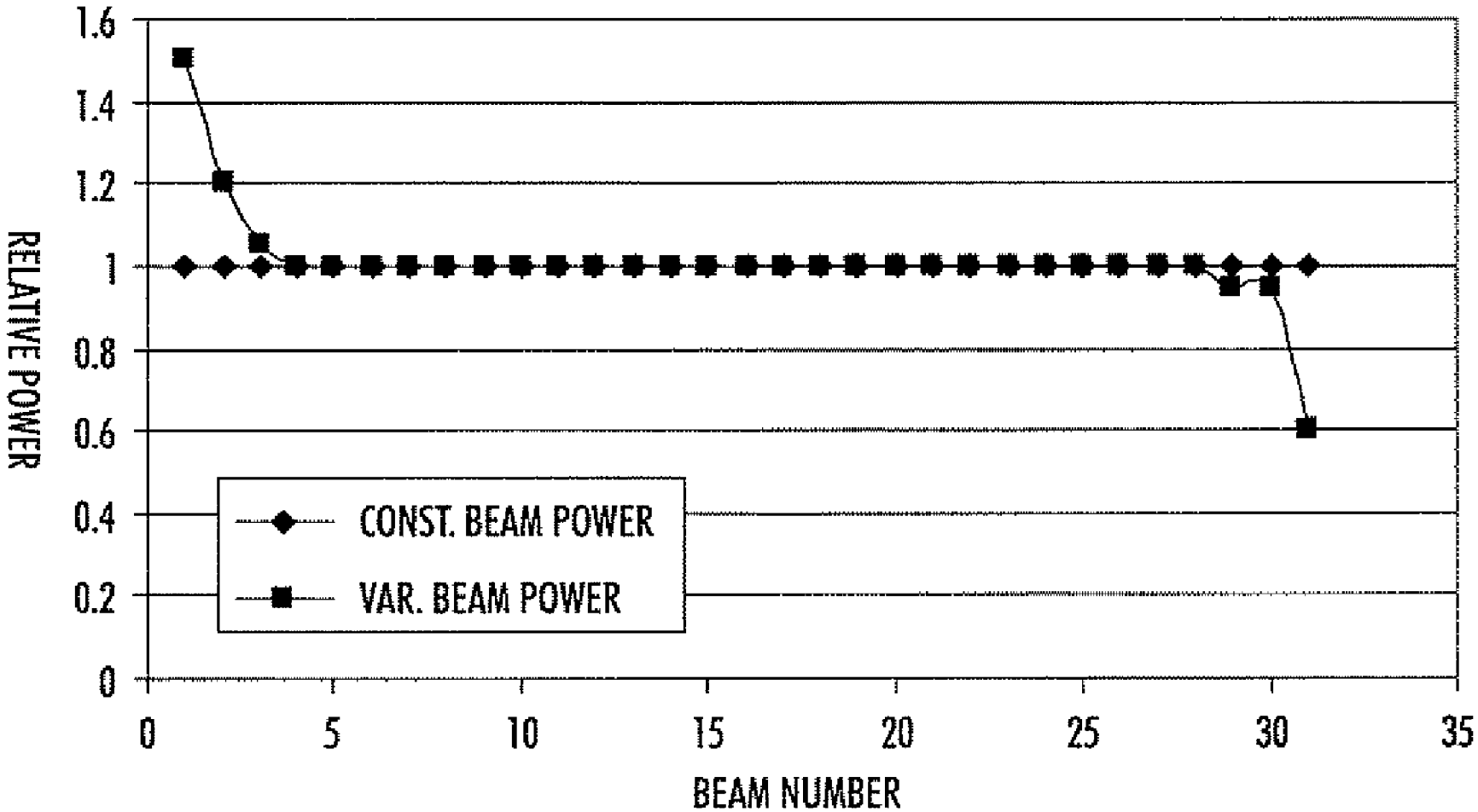
FIG. 11 is a graph showing the relative beam power for multiple beams using two different power distribution profiles.
Figure 12:
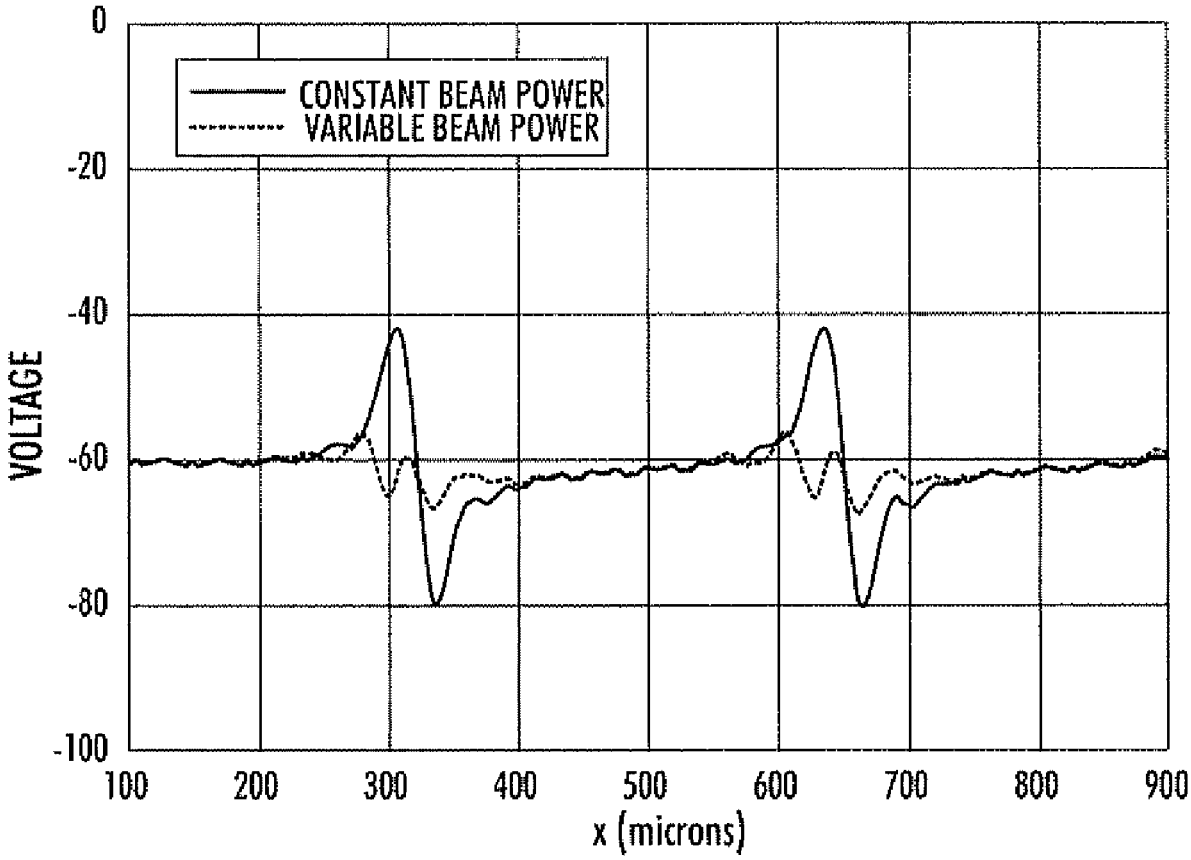
FIG. 12 is a graph of showing the effect on voltage profile over distance for the two different power distribution profiles.

FIGS. 9 and 10 show the voltage uniformity as a function of exposure (i.e. across the PIDC). Specifically, FIG. 9 charts the voltage profile (V) for differing laser beam driving voltages. FIG. 10 charts uniformity of voltage on the electroreceptor (ΔV) for the same set of driving voltages. These are presented for reference purposes.

In order to remove the banding defects, it was determined that an understanding of the cause of the electric field attenuation was needed. Therefore, the electric field attenuation, of the simulated latent images, was compared against the pixel patterns in the three interlace patterns 210, 220, 230. It was determined that electric field attenuation was a function of the distance between neighboring pixels 212, 222, 232 and swaths 202. As discussed above, when a given pixel is struck by a laser beam, the photons in the beam are converted to electrons-hole pairs on the generator layer surface. While the electrons move almost instantly to the ground plane, however, for a small period of time, in the range of 10 milliseconds, the holes continue to move across the transport layer. During this period, if a second laser beam strikes an area within a certain radius of the first pixel, these mobile holes can attenuate the electric field in the nearby area on the generator layer.

The investigation compared the different banding effects observed in the three interlace patterns, against the timing patterns and distance between pixels in the three interlace patterns 210, 220, 230. In doing so, the investigation was able to calculate relationships between the known timing and pixel distance values and the resulting electrical field attenuation. Based on these relationships, methods and an apparatus for correcting the banding defects caused by the electrical field attenuation were developed.

Based on this work, several potential methods for correcting the banding defects were developed, involving modulating the laser beams 104 to compensate for the attenuated electrical fields. Specifically, the methods individually modulate any one of the driving voltage, the timing, or the intensity of the laser beams 104. In the most preferable embodiments, the driving voltage of the laser beams are modulated by a modulation unit 152. By modulating the laser beams, those pixels in which an altered electrical field is expected will receive an modulated laser beam to compensate for the attenuating effect of the altered electrical field.

However, in order for the image modulation unit 152 to successfully modulate the individual laser beams 104, the image forming device must know how much modulation each individual laser beam 104 will need to compensate for the attenuating effects. In the various exemplary embodiments, several different methods of determining a power distribution profile ("PDP") are used. The PDP contains information necessary to determine the needed amount of modulation to the driving voltage of an individual laser beam.

Embodiment 1

Figure 13:
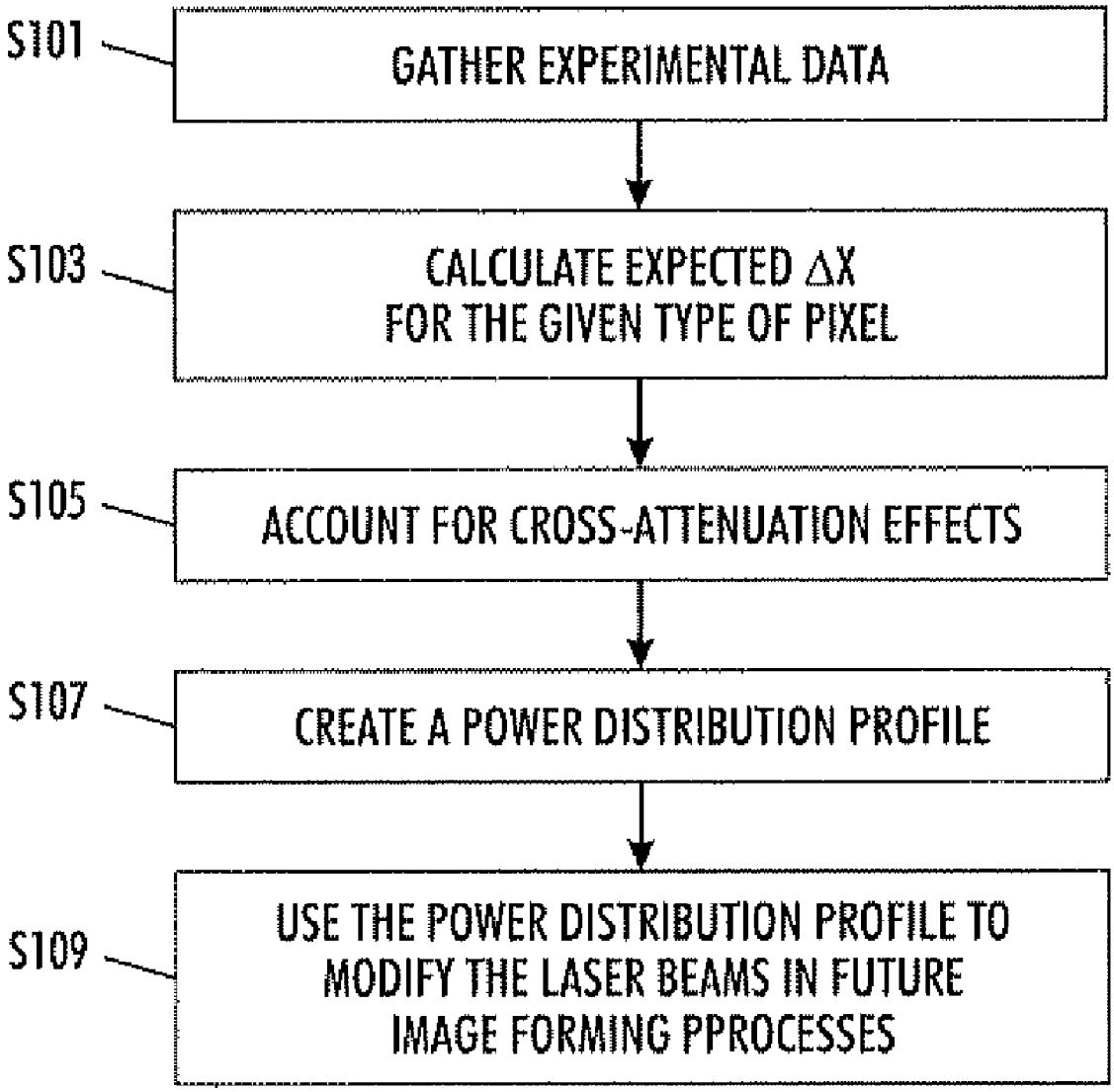
FIG. 13 is a flowchart illustrating a first embodiment of a method for correcting banding defects.

In a first embodiment, the method illustrated in FIG. 13 is used to correct for banding defects. In step S101 experimental data and/or theoretical data are obtained to determine the banding defects which will occur to a given type of image. This given type of image is defined by the halftone density of the pixels in the image. As is well known in the image forming art, when printing images, pixels can have a variety of tones such as full tone, halftone, etc. Another factor is the type of interlace pattern the image will be formed in. For a given interlace pattern 210, 220, 230, each pixel 212 in a scan line will formed by a specific beam in the swath 202. In typical image forming processes, the given type of image being formed is provided to the modulation unit 152 by an outside data source.

Based on experimental and theoretical data, the expected defects for the given image will be calculated, in step S101. This defect will be in the form of the difference in charge $\Delta V_i$ on the photoreceptor between what is desired and what is expected to be present at pixel i in a scan line of the given type of pixel.

Next, in step S103 the change in exposure ΔX needed to correct the defect of each pixel in a scan line, is be calculated. In other words, $\Delta X_i$ is calculated, where i is the given pixel on the scan line. $\Delta X_i$ is calculated using formula (1), based on the $\Delta V_i$ determined in step S101.

It might be expected that once we know the needed change in exposure $\Delta X_i$ for each pixel in a scan line is known, the defects could then be eliminated by altering the driving voltage of the laser beams 104 to provide the modulated amount of exposure by a given laser $\Delta p_j$. However, every alteration in beam exposure to a given pixel location, will inevitably result in ripple effects to pixels around it. Therefore, unless the total effect on the entire voltage profile V of the latent image 670 is considered, defects will not be eliminated.

Therefore, in step S105 the effect that each modulation in exposure $\Delta p_j$ by each laser beam j has on every other pixel i is accounted for. In various exemplary embodiments, these cross-attenuation effects will be accounted for by minimizing the formula $$\sum_i (\Delta X_i - \Delta X_i^*)^2 \tag{3}$$

as $\Delta p_j$ is changed for the given type of pixel. In formula (3) is $\Delta X_i$ is calculated using the formula $$\Delta X_i = \frac{\Delta V_i}{S_v(X)} \tag{4}$$

and $\Delta X_i^*$ is calculated using the formula $$\Delta X_i^* = \sum_{j=1}^{N_b} \beta_{ij} \Delta p_j \tag{5}$$

In formula (5) $N_b$ is the total number of laser beams. Additionally, $\beta_{ij}$ is an exposure contribution for laser beam j at location i. More specifically, $\beta_{ij}$ is a matrix based on several of the intrinsic properties of the image forming device and allows for the effect of every laser beam on every pixel to be accounted for when correcting for banding defects.

To explain further, $\Delta X_i^*$ is the sum of $\beta_{ij}$ matrix multiplied by $\Delta p_j$. As noted above, $\beta_{ij}$ is the exposure contribution for laser beam j at location i. Based on the investigation, it was determined that several factors will affect the expected electrical field attenuation of a given pixel. Some of these factors are dependent on the image to be formed, while others are image independent and result solely from the intrinsic properties of the image forming device.

Among the intrinsic properties of the image forming device that will affect electrical field attenuation of a given pixel are: number of lasers beams, the types of laser beams, the beam spot size (s), the beam to beam spacing, the optical elements, and the electrostatic material of the photoreceptor. These will be collectively referred to as the intrinsic factors. Some image specific properties which will affect electrical field attenuation of a given pixel are: the speed at which the latent image is formed, the tone of the desired image and the interlace pattern. $\beta_{ij}$ defines the attenuating effect that laser beam j will experience at any given pixel i, based on the effects of the intrinsic properties of the printer, as well as the plurality of other laser beams.

Therefore, in summary $\Delta X_i$ defines the actual exposure which will occur at pixel i, after accounting for the attenuation ripple effects that the modulation of beam j, at location i, will have on and from the surrounding pixels and laser beams.

Finally, as discussed above, $\Delta p_j$ is the required additional exposure that will bridge the gap between $\Delta X_i^*$ and $\Delta X_i$. Specifically, $\Delta p_j$ is the additional number of photons we wish for exposure on the photoreceptor at pixel j to ensure pixel j reaches its intended voltage while accounting for its affect on neighboring pixels.

As $\Delta p_j$ is modified, it is possible to minimize the difference between $\Delta X_i^*$ and $\Delta X_i$. Thus, formula (3) can be minimized by modifying $\Delta p_j$. The optimization process continues as the various interactions between the $N_j$ number of laser beams 104 being modified at the various pixels are collectively accounted for.

Eventually, a $\Delta p_j$ is determined for each laser beam j, for every pixel i in the scan line for the given type of pixel. For example, every time the image forming device intends to form a full tone pixel, in an overlapping interlace pattern 1, in the third scan line down in the interlace pattern, $\Delta p_j$'s worth of extra (or less) exposure will be incident on the pixel to ensure the proper charge is laid down.

Once $\Delta p_j$ is calculated for each give type of pixel, the power distribution profile necessary to provide the proper $\Delta p_j$'s is calculated in step S107. The power distribution profile would typically constitute a collection of modified driving voltages to be applied at pixel location i along the scan line. The necessary calculations needed to determine a modulation of a driving voltage to achieve a given change in exposure are well known in the art, and will not be discussed here. Finally, in step S109 the power distribution profile is thereafter used when forming the image.

Embodiment 2

In a second envisioned embodiment, the Power Distribution Profile is determined by forming a test image of a uniform halftone density by the image forming device. This test image will be checked for imperfections in luminance L*. Based on any imperfections found, the power distribution profile will be obtained.

Figure 14:
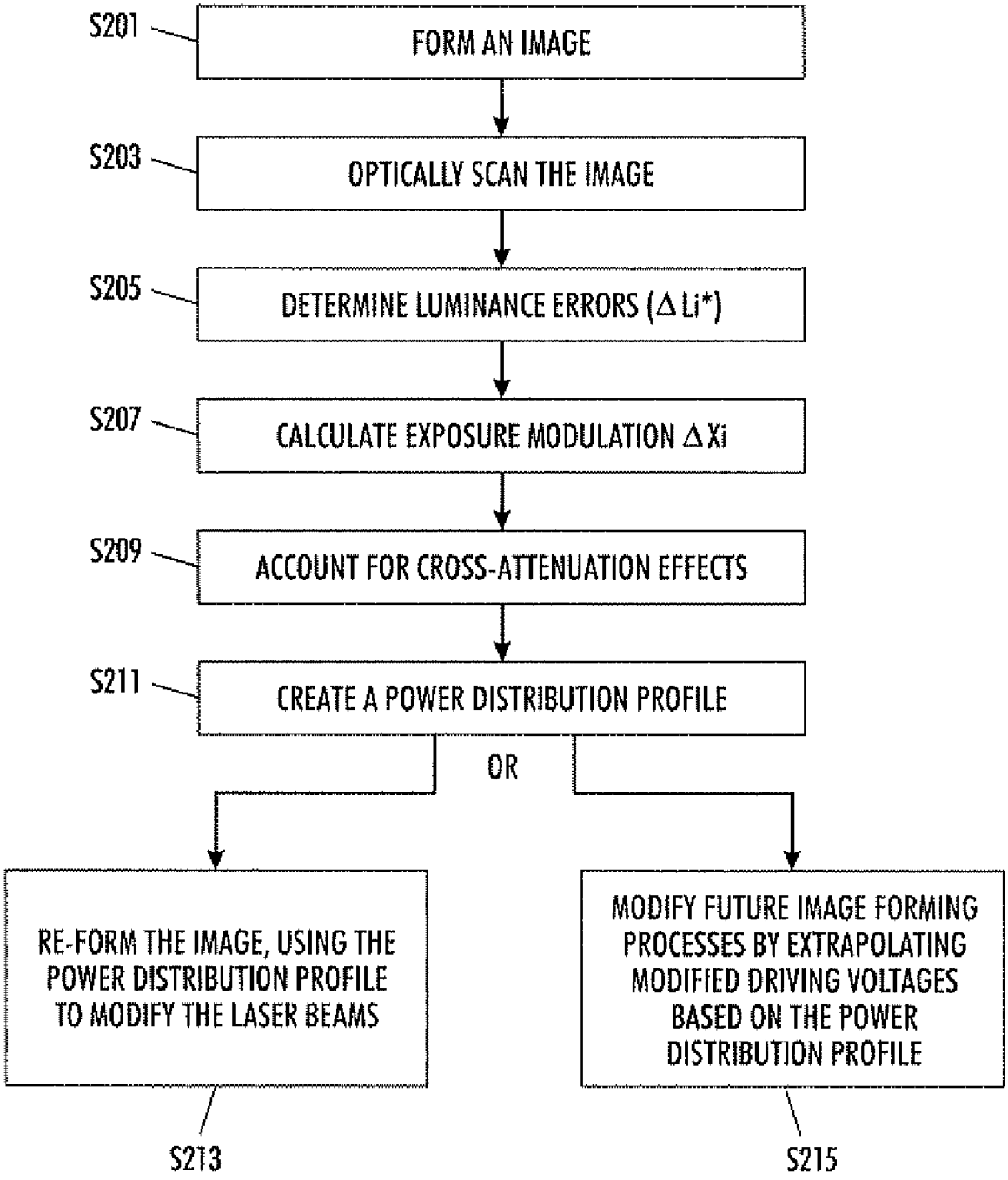
FIG. 14 is a flowchart illustrating a second embodiment of a method for correcting banding defects.

To further elaborate on this envisioned embodiment, and with reference to FIG. 14 the process would begin at step S201 by forming an image using the image forming apparatus. In step S203 the formed image would be optically scanned by a optical scanner 620 and the luminance value L*of each scanline i would be determined. Note that the optical scanner 620 may be positioned within the housing the image forming apparatus or may be an external unit.

Next in step S205 the luminance error detection unit 690 would compare the luminance values of each scanline, against an predetermined expected value for the halftone density of the test image. Based on this comparison, a set of luminance error values $\Delta L_i^*$ would be developed. These luminance error values $\Delta L_i^*$ would be sent to a processor 690 that is connected to the laser modulation unit 152.

In step S207 the change in exposure $\Delta X_i$ needed to create the desired $\Delta L_i^*$ is calculated for each scanline in scanline i in the scan line using formula (6) below.

$$\Delta X_i = \frac{\Delta L_i^*}{S_L(X)} \tag{6}$$

These luminance error values $\Delta L_i^*$ are the amount the luminance value L* at scanline i needs to be modified (either up or down). As can easily be see, the formula closely mirrors formula (4). However, in formula (6), rather than dealing with a desired amount of charge $\Delta V_i$ desired at a location i, the desired change in luminance $\Delta L_i^*$ is used. Likewise, $S_L(X)$, as defined in formula (2) is used to determine the necessary change in exposure $\Delta X_i$ needed to create the desired $\Delta L_i^*$.

As discussed above, if only a single pixel were being fixed, it would be easy to modify the luminance value by modifying the exposure at the pixel. However, as discussed above, in any image having multiple pixels it is necessary to account for the ripple effect each modification will have on every other modification.

Therefore, in step S209 the amount of exposure modulation for each beam j of the swath $\Delta p_j$ needed to correct for all of the luminance errors $\Delta L_i^*$ would be determined. Specifically, the exposure modulation $\Delta p_j$ would be calculated by minimizing the formula $$\sum_i (\Delta X_i - \Delta X_i^*)^2 \tag{3}$$

where, as calculated above $$\Delta X_i = \frac{\Delta L_i^*}{S_L(X)} \tag{6}$$

and where $$\Delta X_i^* = \sum_{j=1}^{N_b} \beta_{ij} \Delta p_j \tag{5}$$

As explained above, as $\Delta p_j$ is modified, it is possible to minimize the difference between $\Delta X_i^*$ and $\Delta X_i$. Thus, formula (3) can be minimized by modifying $\Delta p_j$. The optimization process continues as the various interactions between the $N_j$ number of lasers beams in a swath being modified at the various scanlines are collectively accounted for.

Eventually, a $\Delta p_j$ is determined for each laser beam j, for every pixel in the scan line i for the given halftone density of the test image. For example, every time the image forming device intends to form a pixel, in an overwriting interlace pattern 1, in the third scan line down in the interlace pattern, $\Delta p_j$'s worth of extra (or less) exposure will be incident on the pixel to ensure the proper charge is laid down.

Once $\Delta p_j$ is calculated, the power distribution profile power distribution profile necessary to provide the proper $\Delta p_j$'s is calculated in step S211. As before, the Power Distribution Profile would typically constitute a collection of modified driving voltages to be applied for the given type of pixel at pixel location i along the scan line.

At this time, the method may branch along two further possibilities. If the image formed in step S201 is the desired final image, the image may be re-formed using the power distribution profile to correct for the banding defects in step S213.

Additionally, if the image is reformed in step S213, steps S203 through S213 may be iteratively repeated to further modify and enhance the accuracy of the power distribution profile generated.

The power distribution profile created in steps S201-211 may be used for correcting future images formed. In this embodiment, the Power Distribution Profile profile obtained above is used to modulate the beam power in every swath for all future images formed by the image forming apparatus.

Embodiment 3

In a third envisioned embodiment, the power distribution profile is also determined in a design stage of the image forming device in a manner similar to that of embodiment 2. However, rather than forming a single halftone image, the power distribution profile is developed by forming two or more images each having a different halftone value. This allows for further improvement in the correction of banding defects as will be explained.

Figure 15:
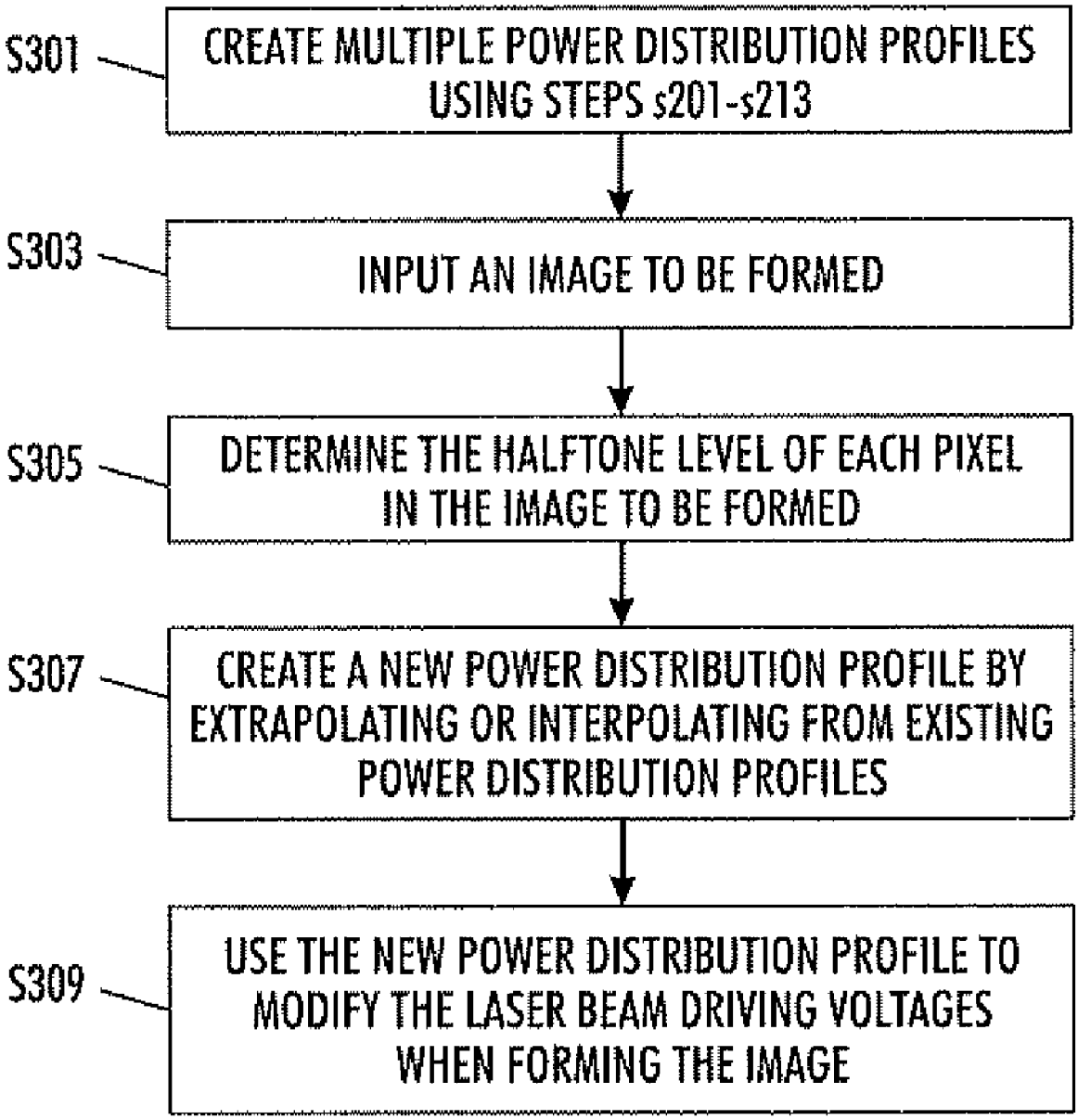
FIG. 15 is a flowchart illustrating a third embodiment of a method for correcting banding defects.

To further elaborate on this envisioned embodiment, and with reference to FIGS. 14 and 15 the process would begin at step S201 by forming a first image having a first halftone value, using the image forming apparatus. In step S203 the first image would be optically scanned by a optical scanner 620 and the luminance value L* of each pixel i would be determined. Note that the optical scanner 620 may be positioned within the housing the image forming apparatus or may be an external unit.

Next in step S205 the luminance error detection unit 690 would compare the luminance values of each pixel, against an predetermined expected value for the pixel. Based on this comparison, a set of luminance error values $\Delta L_i^*$ would be developed.

It should be noted at this time, several changes between the $\Delta L_i^*$ calculated here and the $\Delta V_i$'s calculated in the first embodiment. As discussed above, in the first embodiment a given $\Delta V_i$ was calculated for each pixel i in a scan line, for a given type of pixel. However, in this embodiment such assumptions regarding a given type of pixel are not necessary. The formed image may contain pixels at each scan line 70, each swath 202, and potentially of multiple halftones. Thus, as will be discussed in greater length below, greater accuracy in the banding defect correction may be possible.

In step S207 the change in exposure $\Delta X_i$ needed to create the desired $\Delta L_i^*$ is calculated for each pixel i in the scan line using formula (6) below.

$$\Delta X_i = \frac{\Delta L_i^*}{S_L(X)} \tag{6}$$

These luminance error values $\Delta L_i^*$ are the amount the luminance value L* at pixel i needs to be modified (either up or down).

Next, in step S209 the amount of exposure modulation $\Delta p_j$ needed to correct for all of the luminance errors $\Delta L_i^*$ would be determined in a single series of calculations. Specifically, the exposure modulation $\Delta p_j$ would be calculated by minimizing the formula $$\sum_i (\Delta X_i - \Delta X_i^*)^2 \tag{3}$$

where, as calculated above $$\Delta X_i = \frac{\Delta L_i^*}{S_L(X)} \tag{6}$$

and where $$\Delta X_i^* = \sum_{j=1}^{N_b} \beta_{ij} \Delta p_j \tag{5}$$

As explained above, as $\Delta p_j$ is modified, it is possible to minimize the difference between $\Delta X_i^*$ and $\Delta X_i$. Thus, formula (3) can be minimized by modifying $\Delta p_j$. The optimization process continues as the various interactions between the $N_j$ number of lasers being modified at the various pixels are collectively accounted for.

Eventually, a $\Delta p_j$ is determined for each laser beam j, for every pixel i in the scan line having the first halftone level. Using $\Delta p_j$ a power distribution profile is created for pixels having the first halftone value in step S211.

Next, steps S201-S211 are repeated in which a second image having a second halftone level is formed in step s201. In this manner a second power distribution profiles is created for the second halftone value. Steps s201-s211 may be repeated as many times as desired for as many formed images, each having a unique halftone level, as desired. In this manner two or more power distribution profiles are created for two or more halftone values.

Once the two or more power distribution profiles have been created, in step s303 a desired image to be formed is inputted into the image forming device. For each pixel and halftone level is supplied to the image forming device. In step s305 the halftone level of a pixel to be formed is compared against the halftone levels of the two or more power distribution profiles and the two power distribution profiles having the two closest halftone values are determined. In step s307 a unique power distribution profile for the desired image is determined by either extrapolating or interpolating from the relevant driving voltages in the two or more power distribution profiles for each pixel based on its halftone value. At this stage, the correction to all future images, may be applied in one of several possible ways. One possible method would be to compute a unique Power Distribution Profile based on the average halftone density of the image, through interpolation of the Power Distribution Profiles obtained for the discrete halftone values in the test images. A second method would be to compute a unique Power Distribution Profile for each swath based on a weighted average halftone density of the image pixels in the swath and the neighboring swaths. Another method would be to compute a unique Power Distribution Profile to each pixel in a swath based on a weighted average halftone density of the surrounding pixels. Each of the above methods would result in a unique Power Distribution Profile to be applied to the entire image, or to each swath of the image or to each pixel in the swath.

Finally, in step s309 the laser beam modulation unit 152 supplies the modulated driving voltage to the laser 150. In this manner a more precise driving voltage correction may be applied. It anticipated that as more additional power distribution profiles are created, the more accurate the interpolated driving voltages will be in removing banding defects.

Embodiment 4

Figure 16:
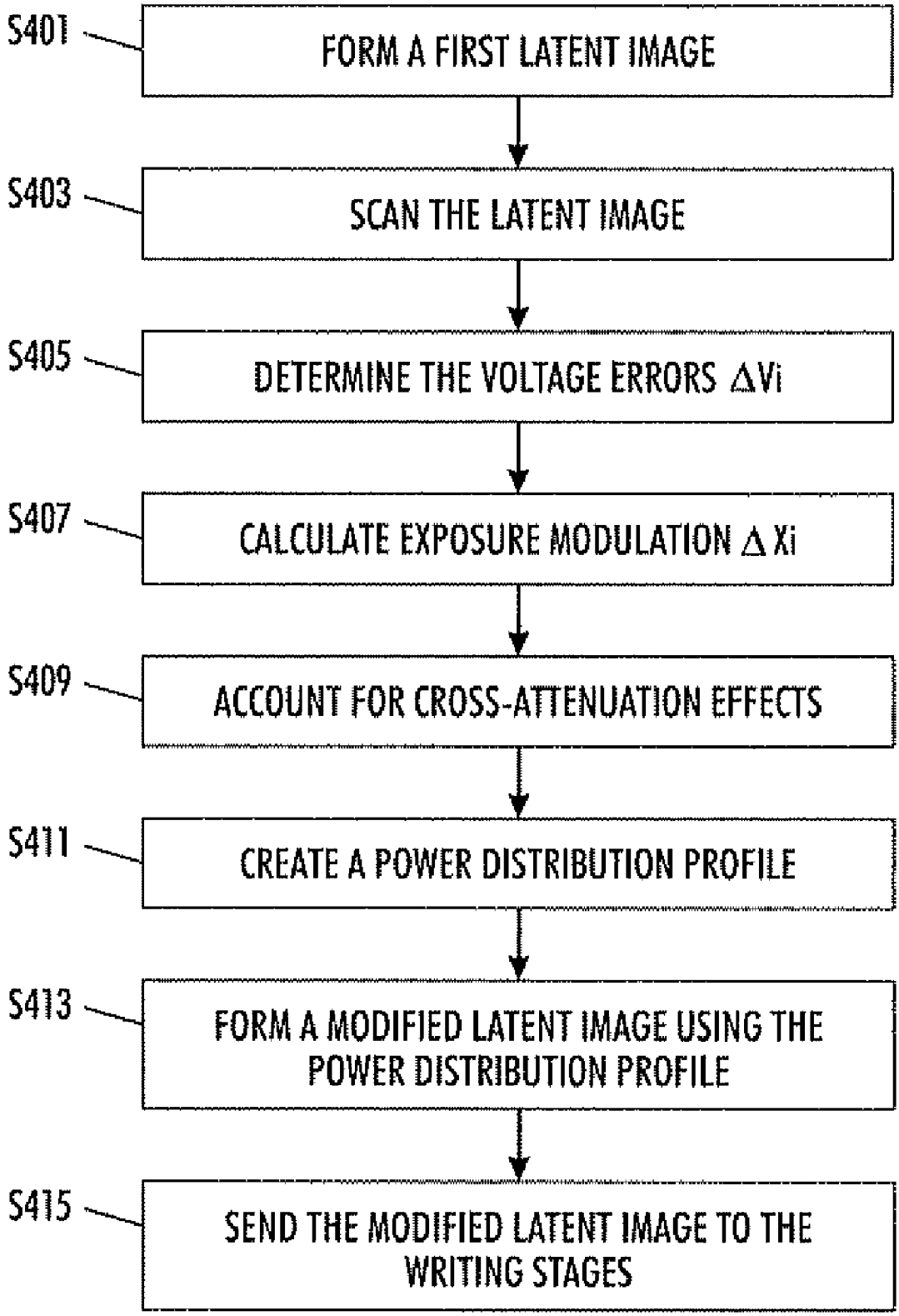
FIG. 16 is a flowchart illustrating a fourth embodiment of a method for correcting banding defects.

In a further envisioned embodiment, the latent image on the photoreceptor would be modified prior to the writing stage of the image forming process. Referring now to FIG. 16, in step s401 a first latent image 670 would be formed on the photoreceptor 10. In step s403 the voltage profile V of the first latent image would be determined using one of several potential methods, discussed shortly.

Next, in step s405 the voltage profile V would be compared against an expected voltage profile, and a set of voltage errors $\Delta V_i$ would be created. Then in step s407 the necessary exposure modulations $\Delta X_i$ needed to correct for these voltage errors $\Delta V_i$ would calculated using formula (4). Furthermore in step s409 the attenuation ripple effects due to the modulation of each pixel would be calculated by minimizing formula (3).

A power distribution profile for fixing the banding defects in the latent image would be created in step s411 based on the $\Delta p_j$ calculated in step s409. A second latent image would then be formed using this power distribution profile in step s413. Finally, in step s415 the second latent image would be sent to the writing stages of the image forming apparatus. In this manner, a dynamic method for correcting banding defects could be accomplished. Furthermore, because no interpolation or pixel assumptions need to be made in this potential embodiment, yet further reduction of banding defects are anticipated.

Referring back to step s403, any known method in the art for determining the voltage profile of the latent image may be used. Referring to FIG. 17, one envisioned embodiment would be a sensor 610 capable of reading the voltage profile of the first latent image 670 directly off the photoreceptor 10. Such a system is discussed in U.S. Pat. No. 7,120,369 hereby incorporated by reference. Data read from the sensor 610 would be sent to a processor 690, where the set of error values would be calculated.

In an alternative embodiment, the latent image would be placed in proximity to toner, or a similar writing material. The photoreceptor 10 with the toner would be scanned by the sensor 610, which would determine the voltage profile based off of the latent image 670 shown in the toner. The toner would then be cleaned off the photoreceptor 10 before the modified latent image would be formed.

It will be appreciated that various of the above-disclosed and other features and functions, or alternatives thereof, may be desirably combined in many other embodiments, systems or applications. Also, various presently unforeseen or unanticipated alternatives, modifications, variations or improvements may be subsequently made by those of skill in the art, and are also intended to be encompassed by the following claims.

What is claimed is:

1. A method for correcting banding defects in a photoreceptor image forming apparatus, the method comprising:

forming one or more images using one or more laser beams;

checking the one or more images for one or more sets of image imperfections arising from an electric field attenuation in the photoreceptor;

compensating for the electric field attenuation;

wherein the compensating comprises generating a power distribution profile for the one or more laser beams, and modulating power to one or more laser beams based on the power distribution profile; and forming a compensated desired image, wherein the one or more sets of image imperfections is a set of luminance errors at location i of the luminance value $\Delta L_i^*$, and wherein a laser beam j of the one or more laser beams is modulated to alter an exposure of the laser beam by $\Delta p_j$, where $\Delta p_j$ is estimated by minimizing the formula $$\sum_i (\Delta X_i - \Delta X_i^*)^2$$

where $$\Delta X_i = \frac{\Delta L_i^*}{S(X)}$$

where $$\Delta X_i^* = \sum_{j=1}^{N_b} \beta_{ij} \Delta p_j; \text{ and}$$

where:

S(X) is a slope of a luminance to exposure intensity curve at exposure X, $\beta_{ij}$ is an exposure contribution for laser beam j at location i, and $N_b$ is the total number of laser beams.

2. The method of claim 1, wherein the modulating involves altering at least one of a driving voltage, an intensity or a duration of the one or more laser beams.

3. The method of claim 1, wherein the power distribution profile is generated based on the set of image imperfections.

4. The method of claim 1, wherein the checking further comprises comparing the one or more formed images against one or more corresponding predetermined expected images.

5. The method of claim 1, wherein the one or more images each have a different halftone level, and the compensating is based on the halftone level of a desired image to be formed.

6. The method of claim 5, further comprising:

generating two or more power distribution profiles based on two or more sets of image imperfections;

determining a desired halftone level of the desired image to be formed;

interpolating or extrapolating a desired power distribution profile from the two or more power distribution profiles based on the desired halftone level as compared to the halftone levels of the images the two or more power distribution profiles were generated from; and compensating for field attenuation using the desired power distribution profile.

7. A xerographic machine employing the method of claim 1.

8. A method for generating a power distribution profile to modulate one or more laser beams so as to compensate for electric field attenuation in a photoreceptor image forming apparatus, the method comprising:

forming an image using the one or more laser beams;

checking the image for a set of image imperfections arising from electrostatic charge attenuation in the photoreceptor; and generating a power distribution profile for the one or more laser beams based on the set of image imperfections, wherein the set of image imperfections are obtained by comparing the formed image against a predetermined expected image, and wherein the set of image imperfections is a set of errors of the luminance value $\Delta L_i^*$, and wherein the power distribution profile is such that an exposure generated by any laser beam j of the one or more laser beams is altered by an exposure modulation $\Delta p_j$, where $\Delta p_j$ is estimated by minimizing the formula $$\sum_i (\Delta X_i - \Delta X_i^*)^2$$

where $$\Delta X_i = \frac{\Delta L_i^*}{S(X)}$$

where $$\Delta X_i^* = \sum_{j=1}^{N_b} \beta_{ij} \Delta p_j; \text{ and}$$

where:

$L^*$ is a luminance value of a printed image, $\Delta L_i^*$ is an error in the luminance value at location i obtained from the set of image imperfections, S(X) is a slope of a luminance to exposure intensity curve at exposure X, $\beta_{ij}$ is an exposure contribution for laser beam j at location i, and $N_b$ is the total number of laser beams.

9. An image forming apparatus comprising:

a photoreceptor having an electrostatic charge;

one or more laser light sources configured to alter the electrostatic charge;

an image forming material that is attracted to the electrostatic charge of the photoreceptor in proportion to the electrostatic charge;

a laser control unit for individually controlling a driving voltage, intensity and duration of a plurality of laser beams generated by the one or more laser light sources;

a luminance error determining unit that compares a luminance value of a plurality of pixels in a formed image against an expected luminance value for each given pixel i, to obtain a set of luminance errors ($\Delta L_i^*$);

a power distribution profile generating unit that generates a power distribution profile based on the set of luminance errors, and a modulation unit for modulating one or more of the laser beams to compensate for field attenuation, wherein the modulation unit modulates the one or more laser beams based on a power distribution profile, wherein the power distribution profile is such that an exposure generated by any laser beam j of the one or more laser beams is altered by an exposure modulation $\Delta p_j$, where $\Delta p_j$ is estimated by minimizing the formula $$\sum_i (\Delta X_i - \Delta X_i^*)^2$$

where $$\Delta X_i = \frac{\Delta V_i^*}{S(X)}$$

where $$\Delta X_i^* = \sum_{j=1}^{N_b} \beta_{ij} \Delta p_j; \text{ and}$$

where:

$L^*$ is a luminance value of a printed image,

S(X) is a slope of a photo induced discharge curve at exposure X, $\beta_{ij}$ is an exposure contribution for laser beam j at location i, and $N_b$ is the total number of laser beams.

10. The image forming apparatus of claim 9, further comprising:

a testing unit for comparing an electrostatic profile on the photoreceptor against an expected electrostatic profile for a particular image to generate an imperfection profile; and a power distribution profile generating unit that generates a power distribution profile based on the imperfection profile.

11. The image forming apparatus of claim 9, wherein the modulation involves altering at least one of a driving voltage, an intensity or a duration of the one or more laser beams.

12. The image forming apparatus of claim 9, where the laser beam j of the one or more laser beams is modulated to alter an exposure of the laser beam j by $\Delta p_j$, where $\Delta p_j$ is estimated by minimizing the formula $$\sum_i (\Delta X_i - \Delta X_i^*)^2$$

where $$\Delta X_i = \frac{\Delta L_i^*}{S(X)}$$

where $$\Delta X_i^* = \sum_{j=1}^{N_b} \beta_{ij} \Delta p_j; \text{ and}$$

where:

V is a voltage profile of a latent image, $\Delta V_i$ is a change in the voltage profile at location i, S(X) is a slope of a photo induced discharge curve at exposure X, $\beta_{ij}$ is an exposure contribution for the laser beam j at location i, and $N_b$ is the total number of laser beams.

13. The image forming apparatus of claim 12, wherein the scanned profile from an inline scanner of a uniform half tone area is used as a surrogate for the voltage profile (V).

14. The image forming apparatus of claim 12, further comprising:

a voltage profile determining unit that determines the voltage profile (V) of a latent image by determining $\Delta V_i$ at a plurality of locations, where i is a matrix designation for each of the plurality of locations;

a testing unit for comparing against an expected electrostatic profile for a particular image to be formed against the voltage profile of the latent image; and a power distribution profile generating unit that generates a power distribution profile based on the imperfection profile, wherein the modulation unit modulates the one or more laser beams based on the power distribution profile.

* * * * *